United States Patent [19]

Zollenkopf

[11] 4,023,540

[45] May 17, 1977

[54] ROTARY ENGINE

[76] Inventor: Hans Zollenkopf, 4085 Montcalm Crescent, Niagara Falls, Ontario, Canada, L2G 6M1

[22] Filed: Apr. 15, 1976

[21] Appl. No.: 677,398

[52] U.S. Cl. ..... 123/8.43; 123/8.17; 418/175; 418/224; 418/240; 418/247

[51] Int. Cl.[2] ..... F02B 53/00

[58] Field of Search ..... 123/8.17, 8.27, 8.31, 123/8.25, 8.43; 418/175, 224, 240, 247

[56] References Cited

UNITED STATES PATENTS

| | | | |
|---|---|---|---|
| 1,899,374 | 2/1933 | Werle | 123/8.35 |
| 3,181,511 | 5/1965 | Johnson | 123/8.17 |
| 3,230,938 | 1/1966 | Hojnowski | 123/8.43 X |

FOREIGN PATENTS OR APPLICATIONS

| | | | |
|---|---|---|---|
| 814,555 | 3/1937 | France | 123/8.43 |
| 486,195 | 5/1938 | United Kingdom | 123/8.31 |

*Primary Examiner*—Carlton R. Croyle
*Assistant Examiner*—Michael Koczo, Jr.
*Attorney, Agent, or Firm*—Ashlan F. Harlan, Jr.

[57] ABSTRACT

An internal combustion engine of the rotary type which includes a cylindrical rotor having a skirt portion, rotating in an annular chamber, that comprises two arcuate walls of differing radii joined by relatively short, diametrically disposed sloping portions that serve as pistons. A sliding divider which extends through the annular chamber and the skirt portion establishes, with the sloping skirt portions, sub-chambers in the annular chamber in which compression of a combustible gas mixture and combustion of the mixture take place, the latter producing power for moving the rotor and the power shaft attached thereto. The divider is provided with longitudinallly spaced slots in which the rotor skirt is engaged whereby the divider is reciprocated as the sloping portions of the skirt pass through the slots.

9 Claims, 9 Drawing Figures

49
C
41
I
81
87
61
71
57
37
47
39
2
2
85
59
23
P
53
131
69
43
63
19
131
33
83
51
E
71

17
133
11
23
15
13
135
101
79
37
33
39
1
1
29
31
27
101
25
28
53
75
67
73

Fig. 3.
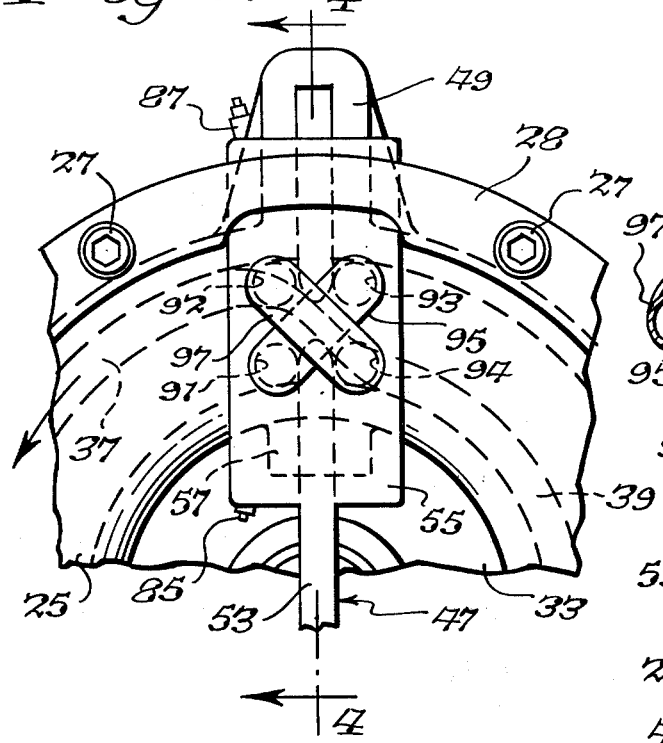
Fig. 4.
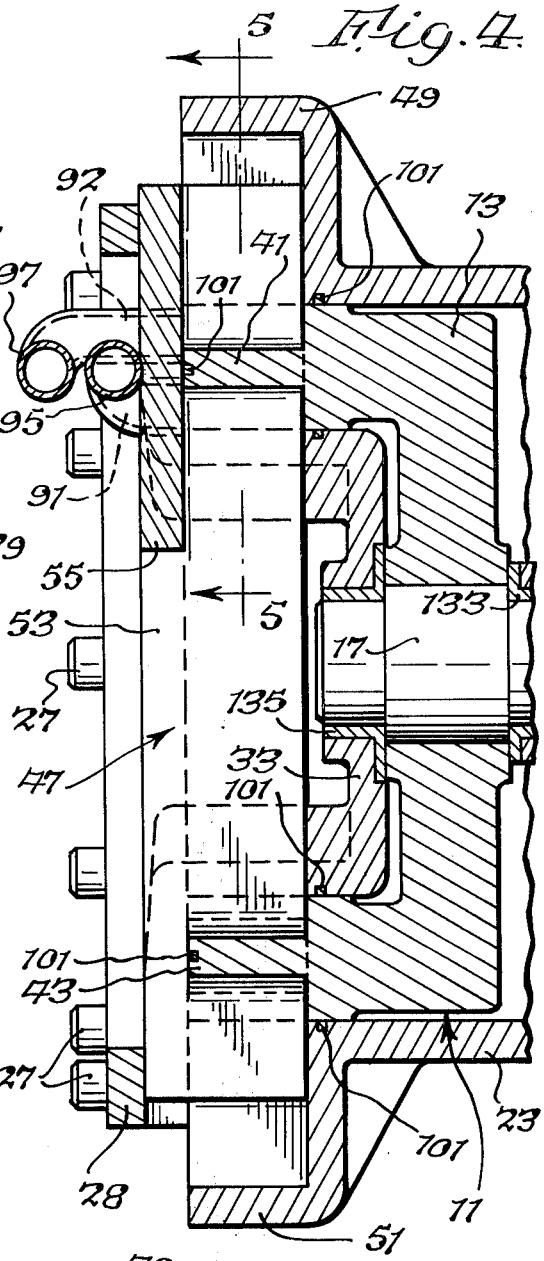
Fig. 6.
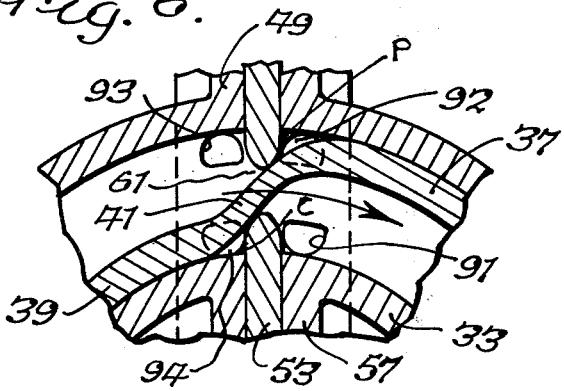
Fig. 7.
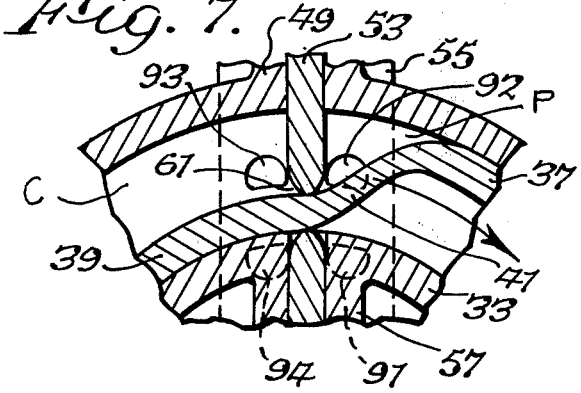
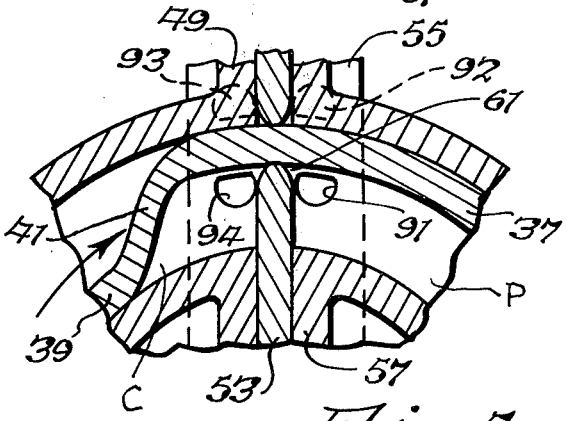
Fig. 5.

ROTARY ENGINE

BACKGROUND OF THE INVENTION

This invention relates to internal combustion engines and is particularly concerned with rotary engines of that type. As is well known, most internal combustion engines have pistons that reciprocate in cylinders and require mechanisms to convert the rectilinear motion of the pistons to the rotary motion that is commonly desired. Accordingly, there has been much interest in the development of engines that provide power from rotating shafts directly driven by the pistons. Although many such engines have been designed, they have not, in general, been satisfactory because of fuel inefficiency, sealing problems, and exhorbitant manufacturing costs incurred in an effort to solve the sealing problems.

It is an object of the present invention to provide a rotary internal combustion engine that is compact, simple, and efficient, and which is inexpensive to manufacture.

SUMMARY OF THE INVENTION

In achieving such an engine, there is provided a cylindrical rotor having a skirt portion, preferably integral therewith, rotating in an annular chamber of a casing. The skirt portion comprises two arcuate walls of differing radii joined by relatively short, diametrically disposed, sloping portions that serve as pistons. A sliding divider that extends through the rotor skirt and chamber establishes, with the sloping skirt portions, sub-chambers in said annular chamber in which a combustible gas mixture is compressed and fired to produce power for moving said rotor. An output or power shaft non-rotatably attached to said rotor concentrically thereof. The divider is provided with longitudinally spaced slots in which the rotor skirt engages for reciprocating the divider as the sloping portions of the skirt pass therethrough and with means for transferring the compressed combustible mixture from a compression sub-chamber to a power or combustion sub-chamber.

SHORT DESCRIPTION OF THE DRAWINGS

FIG. 3 is a fragmentary end view of the engine illustrated in FIGS. 1 and 2;

FIG. 4 is a fragmentary view, partly in section, which is similar to FIG. 2 and is taken along the plane of line 4—4 of FIG. 3;

FIGS. 5, 6 and 7 are sectional views, taken along the plane of line 5—5 in FIG. 4, which depict the rotor of the engine in sequential positions;

DESCRIPTION OF THE INVENTION

Figure 1:
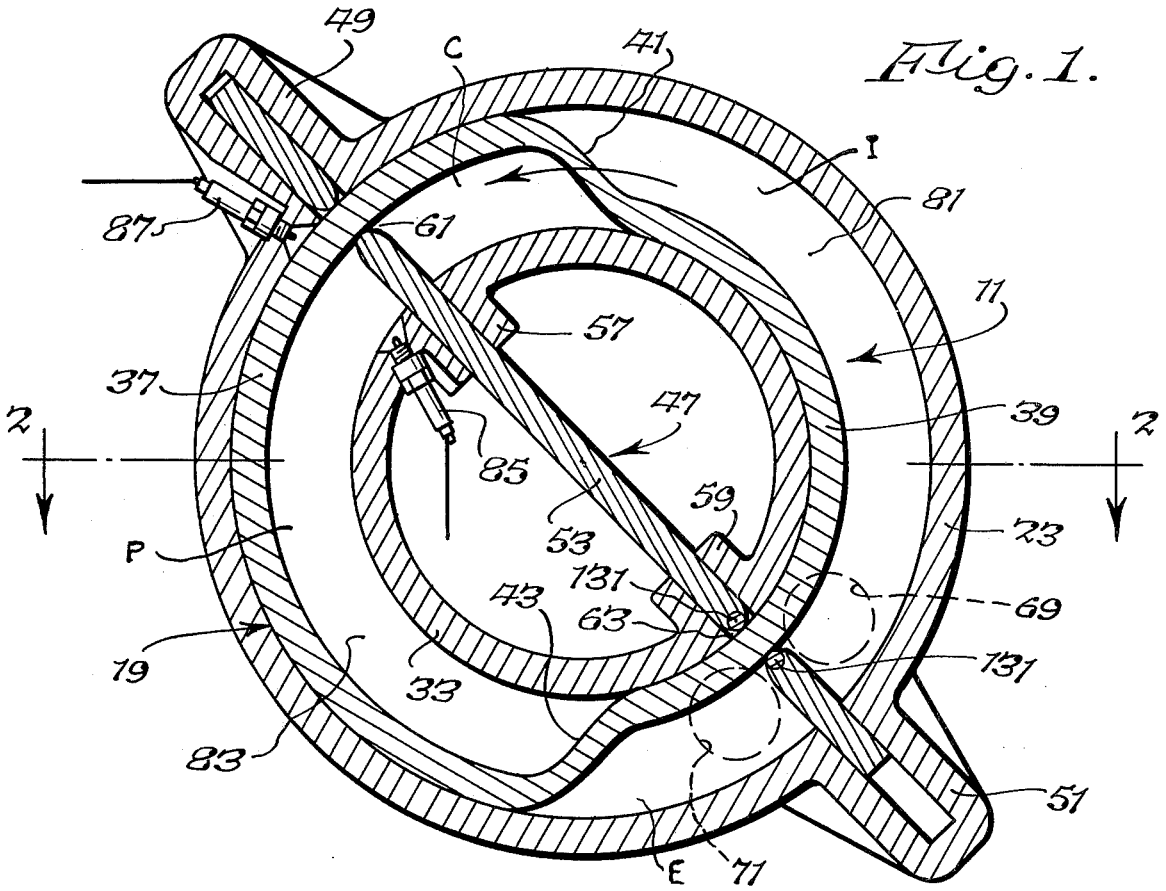
FIG. 1 is a sectional view of a rotary engine according to the invention taken normal to the rotary drive shaft along the plane of line 1—1 of FIG. 2.

The terms "upper", "lower", "top", "bottom", "right", "left", "above", "below", "vertical", and "horizontal", and similar terms of position and/or direction as used hereinafter refer to the illustrations, but are used only for convenience in description and/or reference. Such terms should not be so construed as to imply a necessary positioning of the structure or of portions thereof, or as to limit the scope of this invention.

The novel engine of the present application is extremely simple as it includes only two major moving parts: a rotor and a reciprocating divider or slide. The rotor 11 has a generally cup-shaped body portion 13 with a central, concentric bore 15 in which there is non-rotatably and concentrically secured, by any suitable means (not shown), a drive or output shaft 17 that projects axially from the body portion 13 through the housing (described hereinafter) and is journalled in suitable bearings in the housing.

The rim of the rotor body portion 13 has extending therefrom, in an axial direction, a skirt portion 19 which is preferably integral with the body portion. The rotor 11 is encased in a housing which comprises a base or body portion 23, generally cup-like in shape, having a generally cylindrical peripheral wall and an open end, and a cover portion 25 which closes the open end of the body portion 23. The cover portion 25 of the housing or casing may be secured in suitable manner to the base portion 23, for example by machine screws or bolts 27 passing through an annular retaining plate 28 and peripheral flanges 29 and 31 on the base portion 23 and cover 25, respectively. The cover 25 is provided with a cylindrical guide or re-entrant portion 33, concentric therewith, that projects coaxially into the body portion 23 and the rotor 11 and cooperates therewith as hereinafter described. The guide or re-entrant portion 33 is spaced from the peripheral wall of the body portion 23 to form an annular chamber.

The skirt portion 19 of the rotor body 13 serves as a combined piston and cam. It is formed of two arcuate portions, an outer wall 37 and an inner wall 39, the walls being joined by relatively short, diametrically opposed sloping portions 41 and 43 which are equal in length and mirror images of each other. The sloping skirt portions 41 and 43 are slightly thinner than the arcuate walls. As will be apparent from FIGS. 1 and 2, the rotor 11, including the skirt portion 19 thereof, can rotate about the axis of the housing base 23 and the re-entrant portion of the cover 25. In so doing, the outer face of outer wall 37 of the skirt portion is in contact with the inner, cylindrical surface of the housing and the inner face of inner wall 39 of the portion 19 is in contact with the cylindrical, re-entrant portion 33 of the cover 25. The annular chamber between the housing wall and the re-entrant portion or guide 33 is thus divided by the skirt portion 19 of the rotor 11 into two similar chambers.

There is also provided in the present novel engine a reciprocating, sliding divider or separator 47 which serves to bisect each of the two chambers formed as stated above. The divider or separator extends diametrically through the housing, the ends thereof projecting into the diametrically opposite housing extensions 49 and 51 of the housing base or body portion 23. The divider or separator 47 is formed, conveniently by casting, as an elongated plate 53 (FIG. 4) having adjacent one end and preferably integral therewith a reinforcing orifice plate 55 extending normally to the plate 53. The plate 53 extends through the re-entrant portion 33 of the housing cover 25. The latter is provided with diametrically opposed, inwardly directed protrusions 57 and 59 by which the plate 53 is guided.

The plate 53 of the divider or separator 47 is provided with a pair of longitudinally spaced slots 61 and 63 in which the skirt portion 19 of the rotor 11 is received. Since, because of its design, the total of the distances from the axis of the rotor 11 along any diameter thereof to the inner and outer walls 37 and 39 of the skirt portion 19 is the same, rotation of the latter is not restrained by the divider. Because of the sloping cam portions 41 and 43 of the skirt portion, the divider or separator 47 will be reciprocated as the rotor turns and the portions 41 and 43 thereof pass through the slots 61 and 63.

The housing cover 25 is provided, adjacent one side thereof, with an apertured plate 67. The plate 67 may be formed integrally with the cover 25 or may be separate and attached thereto by suitable means, (not shown). Suitably attached in openings or ports 69 and 71 through the plate 67 are inlet and exhaust pipes 73 and 75, respectively. The openings 69 and 71 are annularly spaced at the same distance from the axis of rotation of the rotor 11, and are centered between the walls 37 and 39 of the skirt portion 19 of the rotor, whereby they afford access to the annular space between the re-entrant portion or guide 33 of the housing cover, and the peripheral wall of the housing body 23.

As pointed out above, and as is evident from FIG. 1 of the drawings, the skirt portion 19 of the rotor 11 divides or forms, within the annular space that lies between the guide or re-entrant portion 33 of the housing cover 25 and the peripheral wall fo the housing base or body 23, two arcuate chambers 81 and 83. The former is bounded by the sloping cam portions 41 and 43, the inner wall portion 39 of the skirt 19, and the peripheral wall of the housing body 23. The chamber 83 is bounded by the cam portions 41 and 43, the outer wall portion 37 of the skirt 19, and the peripheral wall of the re-entrant portion 33. The chambers 81 and 83 are similar although not precisely the same in size and each chamber is further divided by the separator 47 into sub-chambers. as the rotor 11 turns within the housing body 23. Thus, in FIG. 1 the chamber 81 is divided into an exhaust sub-chamber E which is in communication with the exhaust port 71 in the plate 67 and an intake sub-chamber I which is in communication with the inlet port 69 in the plate 67. The divider 47 establishes within the chamber 83 a compression sub-chamber C and a combustion or power sub-chamber P. It will be evident that the sub-chambers shift from chamber 81 to chamber 83 and vice versa as the rotor turns. It will also be evident that the divider 47 prevents communication between the intake and exhaust ports 69 and 71, respectively.

It will be seen from FIG. 1 that the present novel engine is provided with two spark plugs 85 and 87. The plug 85 is mounted in a port extending through the peripheral wall of the guide or re-entrant portion 33 and is adapted to fire in the combustion sub-chamber P of the chamber 83. The spark plug 87 is mounted in a port extending through the peripheral wall of the housing base 23 and is adapted, when the combustion or power sub-chamber P is located in the chamber 81, to fire a combustible gas and air mixture therein. The plugs 85 and 87 are located adjacent the divider 47 on the side of the engine opposite the intake and exhaust ports.

The operation of the present engine is extremely simple. As viewed in FIG. 1, the rotor turns counterclockwise (see directional arrows) and (1) a combustible gas and air mixtue is being drawn into sub-chamber I in chamber 81 through the inlet port 69, (2) combustion product gases in sub-chamber E in chamber 81 are being forced out of the exhaust port 71, (3) the combustible mixture in sub-chamber C in the chamber 83 is being compressed, and (4) pressure is being exerted on the sloping cam portion 43 by expanding combustion gases in the sub-chamber P in the chamber 83, resulting from firing a compressed combustible mixture therein. When the cam portions 41 and 43 pass, respectively, through the slots 61 and 63 in the divider 47, the sub-chambers shift from one chamber to the other. Thus, as each of the sloping cam portions passes through the slot 61, it in effect becomes a piston head for receiving an impulse from the combustion of fuel in the combustion sub-chamber behind it.

In FIGS. 3 and 5–7, the operation of the engine is further illustrated. As will be seen in FIG. 3 and in FIG. 4, the reinforcing orifice plate 55 forming part of divider or separator 47 is provided with four orifices or ports, 91, 92, 93, and 94, therethrough, arranged as if at the corners of a rectangle. A cross tube 95 joining diagonally opposite ports 91 and 93 is suitable secured in said ports and a similar cross tube 97 is suitably secured in the ports 92 and 94 for communication therebetween. These ports and tubes permit transfer of gas from one side of the divider 47 to the other side thereof whereby the combustible gas mixture compressed in the compression sub-chamber C may be confined in a relatively small combustion or power sub-chamber P when ignition of the gases takes place by a spark from the spark plug 87.

FIGS. 5–7 illustrate progressively the movement of the cam portion 41 through the slot 61 in the separator plate 53 and the concomitant changing positions of the ports 91–94. In FIG. 5 the cam portion 41 is approaching the slot 61 and the compression sub-chamber C is diminishing in size. Since the ports 91 and 94 are not connected and the ports 92 and 93 are covered, the compressed gases in the sub-chamber C and the combustion gases in the power or combustion sub-chamber P are retained in the respective chambers. As illustrated in FIG. 6, the cam portion 41 in moving through the slot 61 displaces the divider 47 downwardly and opens communication from the compression sub-chamber C to the combustion sub-chamber P, the compressed combustible gas and air mixture in the sub-chamber C being passed into the sub-chamber P through the ports 94 and 92 and the connecting tube 97. When the inner wall 39 of skirt portion 19 of the rotor enters the slot 61, (see FIG. 7), the combustible mixture has been transferred to the combustion or power sub-chamber P in the chamber 81 where it is ignited by means of the spark plug 87 (not shown in FIGS. 5–7). The combustion gases resulting from the ignition in sub-chamber P provide pressure against the sloping cam portion 41 to produce continued rotation of the rotor.

It will be understood that, as shown in FIG. 1, access from the sub-chambers I and E to the intake port 69 and the exhaust port 71, respectively, is provided on the opposite side of the engine, the sub-chambers being separated by the divider 47. As a result of the engine design, such access is synchronized with the compression and ignition. It will also be understood that ignition takes place, alternately, in chambers 81 and 83 whereby there are two power impulses imparted to the rotor 11 during each 360° rotation thereof.

Figure 2:
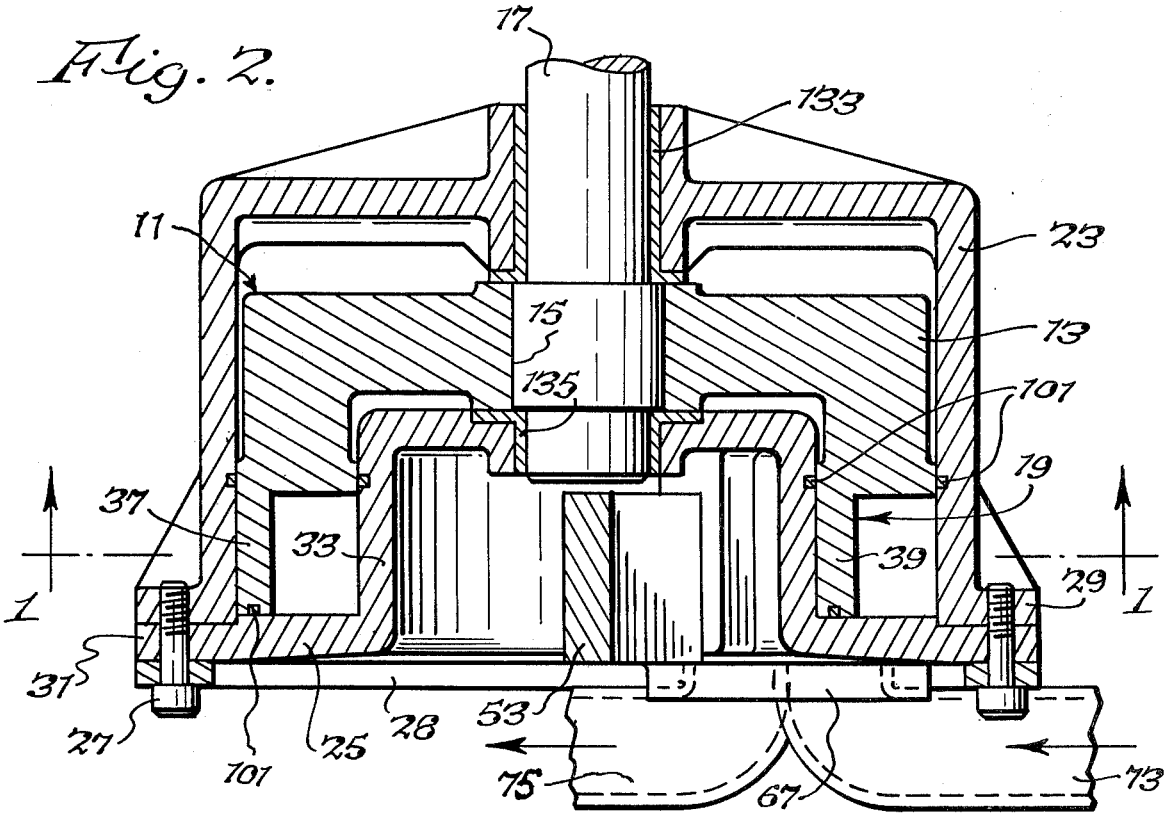
FIG. 2 is a sectional view of the rotary engine shown in FIG. 1 taken along the plane of line 2—2 of FIG. 1.

Sealing of the novel engine of the present invention to prevent or minimize leakage of gases is relatively uncomplicated. 0-ring packing such as shown at 101 in FIGS. 2 and 4 can be used where shown and at other necessary or desired places. It may be of any suitable type. Since the pressure differentials on opposite sides of the divider plate 53 adjacent the slot 61 are at times relatively great, it may be desired to reduce wear and minimize leadkage at this point by providing facings of suitable material on the slot edges or by providing additional sealing against the skirt portion 19 of the rotor 11 which will minimize the effects if wear occurs. There is described below a modified construction which will provide such additional sealing.

Figure 8:
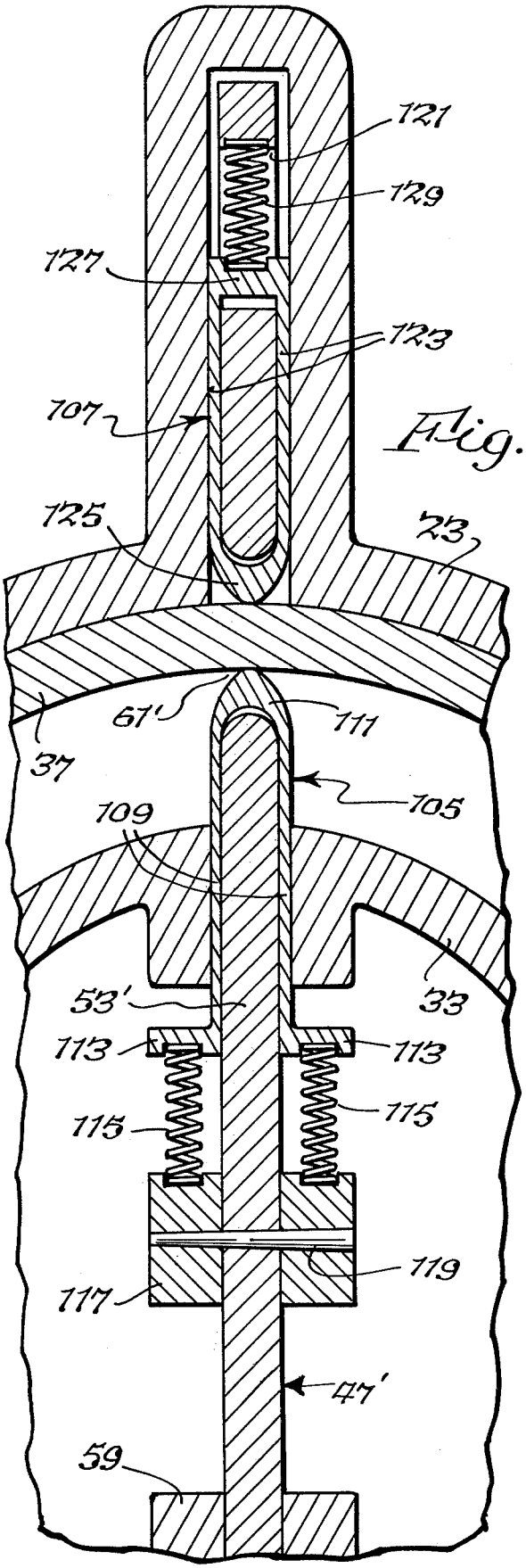
FIG. 8 is an enlarged, sectional detail view of a slide or divider modification.
Figure 9:
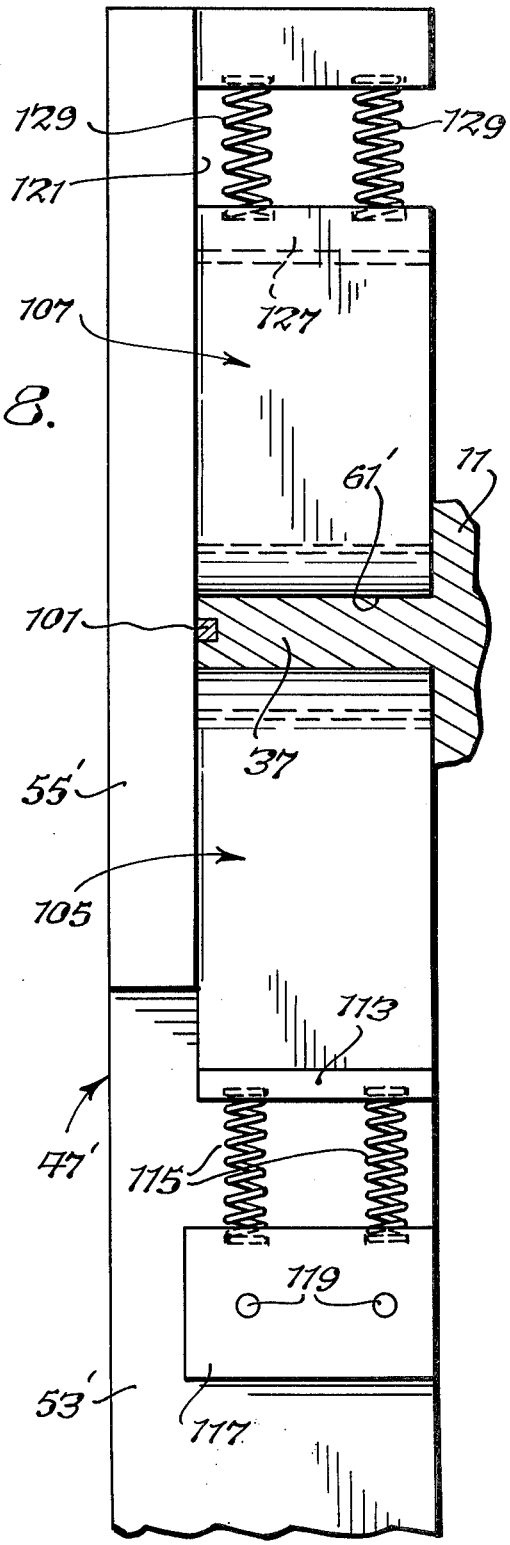
FIG. 9 is an elevational view of the modified slide or divider.

FIGS. 8 and 9 illustrate the above-mentioned modification FIG. 8 being similar to a portion of FIG. 1, but enlarged. It will be understood that the basic construction of the modified engine is essentially the same as shown in the preceding figures. However, the divider or separator 47' is provided, adjacent the end thereof which separates the compression and combustion sub-chambers and which is guided by the boss or protrusion 57' and 49', with spring pressed sealing members. As shown, the slot 61' in the plate 53' of divider 47' is proportionately wider than the corresponding slot 61 in plate 53 to accomodate the sliding sealing members 105 and 107 mounted on the plate 53' at the sides of the gap 61'.

The lower sealing member 105 is preferably integral and is slidably mounted on the plate 53' on the inner side of the skirt portion 19. It comprises substantially parallel side walls 109 joined by a closed end portion 111 having a rounded conical cross-section. At their other ends, the side walls 109 are formed with laterally projecting flanges 113. The sealing member 105 is biased toward the skirt portion 19 by compression springs 115 mounted between the flanges 113 and a block 117 spaced therefrom and removably secured by suitable means such as pins 119, to the divider plate 53'.

Adjacent the upper end of the divider 47' (FIGS. 8 and 9), a slot 121 is provided in the plate 53'. This permits slidably mounting on the plate the other sealing member 107 which, like the member 105, comprises a pair of substantially parallel sides 123 coming together in a closed end portion 125 having a rounded conical cross-section. The other end of the sealing member is also preferably closed by a narrow plate or bar 127 with which the sides 123 are preferably integral. The sealing member 107 is biased toward the skirt portion 19 by compression springs 129 mounted in the slot 121, the ends of the respective springs bearing against the top end of the slot 121 and the plate or bar 127. The members 105 and 107 will maintain sealing engagement with the skirt portion 19 against high pressures even when wear has taken place. They may be formed of any suitable material.

Certain details fo the present engine which form no part of the invention have been described and/or shown only casually or inferentially. Thus, for example, it will be apparent that the bearings 133 and 135 for the shaft 17, shown conventionally in the drawings, may be of any suitable type, antifriction bearings being preferred. Although not necessary in engines according to the invention which are of small diameter, in such engines of larger diameter it may be desirable to provide antifriction bearings (not shown) between the top surface (FIG. 2) of the rotor and the adjacent end wall of the casing 23. Further, as shown in FIG. 1, it is preferred to provide on the facing edges of the slot 63 in the divider plate 53 rollers 131. These tend to ensure reduced wear and friction and may be of any suitable construction whereby there is good sealing between the rollers and both the plate 53 and the skirt portion 19 of the rotor. It will also be obvious that a combustible gas mixture for use in the present engine can be produced in any desired manner and that a suitable ignition system including a timer can be provided to cause firing of said mixture at proper times. Further, suitable means can be provided for providing lubricating oil to the contacting moving surfaces in the engine not only to lubricate, but also to cool the parts, although the walls of the engine can also, if desired, be provided with cooling passages and/or water jackets.

Engines according to the invention may vary in size as desired and can be used in multiple on the same shaft, preferably so offset that variation in torque will be evened out. Although shown and described herein as using an ignition system to fire the combustible gas mixture, engines according to the invention can employ compression ignition as in diesel engine or may be provided with a fuel injection system, if desired. It will be understood that the engines can be constructed of any suitable material.

It will be further understood that modifications of the structure illustrated and described can be made without departing from the spirit of the invention. Thus, the casing may be provided with means for mounting the engine on a vehicle and the rotor can be provided with holes in its sides for balancing. Suitable means may also be provided by means of which a small amount of hot gas from an exhaust sub-chamber can be introduced into a combustion sub-chamber to ignite the combustible gas mixture in the latter.

From the foregoing it will be apparent that the present invention provides a novel engine in which even torque is produced since there are two power impulses during each rotation of the output shaft, in which there are a minimum of moving parts, and in which sealing is relatively easy.

I claim: .

1. In an internal combustion engine: a housing body having a generally cylindrical peripheral wall and an open end; a housing cover secured to said body and substantially closing said open end; a cylindrical guide carried by said cover and projecting into said body coaxially therewith; said guide being spaced from said peripheral wall to provide an annular chamber; a rotor mounted in said chamber and engaging the peripheral wall of said body and said guide; a shaft journaled in said body and said guide for rotary movement, said shaft being non-rotatably secured to said rotor concentrically thereof; said rotor having a skirt portion projecting therefrom in an axial direction, said skirt portion comprising two arcuate portions and having an outer wall engaging the peripheral wall of said body and an inner wall engaging said guide, said walls being connected by diametrically disposed sloping cam portions of said skirt; a transverse slide extending diametrically of said housing body and having longitudinally spaced slots therein, said skirt portion being engaged in said slots and being adapted to reciprocate said slide by means of said sloping cam portions as said rotor rotates; said slide and said sloping cam portions dividing said annular chamber into sub-chambers in which a combustible gas mixture may be compressed and ignited, whereby force is exerted on said sloping cam portions to rotate said rotor and shaft; first means which communicates with said annular chamber for supplying fuel thereto and second means which communicates with said annular chamber for exhausting combustion products therefrom.

2. An internal combustion engine as defined in claim 1 wherein said first means comprises means for supplying a combustible gas mixture.

3. An internal combustion engine as defined in claim 2 wherein said first means and said second means are adjacent but separated by said slide.

4. An internal combustion engine as defined in claim 1 wherein means is provided for igniting said fuel.

5. An internal combustion engine as defined in claim 4 wherein said means for igniting said fuel is substantially diametrically opposite said first means and said second means.

6. An internal combustion engine as defined in claim 2 wherein means is provided for transferring said combustible gas mixture from one sub-chamber to another sub-chamber around said slide.

7. An internal combustion engine as defined in claim 6 wherein said last mentioned means comprises an apertured plate forming a part of said slide.

8. An internal combustion engine as defined in claim 7 wherein said last mentioned means further comprises transfer tubes carried by said apertured plate and communicating with the apertures in said plate.

9. An internal combustion engine as defined in claim 3 wherein means is provided for igniting said fuel and said igniting means is located substantially diametrically opposite said first means and said second means and wherein means including transfer tubes carried by an apertured plate forming a part of said slide is provided for transferring said combustible gas mixture from one sub-chamber to another sub-chamber around said slide.

* * * * *

UNITED STATES PATENT AND TRADEMARK OFFICE

CERTIFICATE OF CORRECTION

PATENT NO. : 4,023,540

DATED : May 17, 1977

INVENTOR(S) : Hans Zollenkopf

It is certified that error appears in the above-identified patent and that said Letters Patent are hereby corrected as shown below:

Column 1, line 34, --is-- has been inserted after "shaft".

Column 3, line 30, "fo" has been changed to --of--.

Column 5, line 9, "leadkage" has been changed to --leakage--.

Column 5, line 58, "fo" has been changed to --of--.

Column 6, line 23, --a-- has been inserted after "in".

Signed and Sealed this

*second* Day of *August 1977*

[SEAL]

*Attest:*

RUTH C. MASON
*Attesting Officer*

C. MARSHALL DANN
*Commissioner of Patents and Trademarks*